US010391766B2

(12) United States Patent
Stoeckle et al.

(10) Patent No.: US 10,391,766 B2
(45) Date of Patent: Aug. 27, 2019

(54) PRINTER AND METHOD TO ACTIVATE PRINT NOZZLES

(71) Applicant: Océ Holding B.V., Venlo (NL)

(72) Inventors: Ulrich Stoeckle, Munich (DE); Philippe Koerner, Forstinning (DE)

(73) Assignee: Océ Holding B.V., Venlo (NL)

( * ) Notice: Subject to any disclaimer, the term of this patent is extended or adjusted under 35 U.S.C. 154(b) by 0 days.

(21) Appl. No.: 15/838,907

(22) Filed: Dec. 12, 2017

(65) Prior Publication Data

US 2018/0170043 A1 Jun. 21, 2018

(30) Foreign Application Priority Data

Dec. 16, 2016 (DE) ..... 10 2016 124 603

(51) Int. Cl.
*B41J 2/045* (2006.01)

(52) U.S. Cl.
CPC ..... *B41J 2/04588* (2013.01); *B41J 2/04581* (2013.01); *B41J 2/04591* (2013.01); *B41J 2/04596* (2013.01)

(58) Field of Classification Search
CPC ..... B41J 2/04588; B41J 2/04581; B41J 2/04591; B41J 2/04596
See application file for complete search history.

(56) References Cited

U.S. PATENT DOCUMENTS

| | | | | |
|---|---|---|---|---|
| 9,340,014 | B2 | 5/2016 | Hitzlsperger et al. | |
| 2002/0167559 | A1 | 11/2002 | Hosono et al. | |
| 2007/0052756 | A1 | 3/2007 | Okuda | |
| 2010/0194804 | A1 | 8/2010 | Ozawa | |
| 2012/0274689 | A1 | 11/2012 | Zhang | |
| 2015/0059644 | A1* | 3/2015 | Watanabe | B05C 11/1021 118/668 |

FOREIGN PATENT DOCUMENTS

| | | | |
|---|---|---|---|
| DE | 60132392 | T2 | 1/2009 |
| DE | 102014112939 | A1 | 3/2016 |

OTHER PUBLICATIONS

German Search Report dated Oct. 6, 2017 for German application No. 10 2016124603.4.

* cited by examiner

*Primary Examiner* — Lamson D Nguyen
(74) *Attorney, Agent, or Firm* — Schiff Hardin LLP

(57) ABSTRACT

In a method to active print nozzles of an inkjet printer including a print head having print nozzles and respective actuators associated with each of the print nozzles, one or more conveying pulses are generated to eject respective droplets of ink from the respective print nozzle; and the actuator is activated with one or more intermediate pulses having an amplitude and/or a duration that is less than an amplitude and/or a duration of the one or more conveying pulses. The one or more intermediate pulses can be configured such that no ink is ejected from the respective print nozzle with the one or more intermediate pulses.

19 Claims, 3 Drawing Sheets

PRINTER AND METHOD TO ACTIVATE PRINT NOZZLES

CROSS REFERENCE TO RELATED APPLICATIONS

This patent application claims priority to German Patent Application No. 102016124603.4, filed Dec. 16, 2016, which is incorporated herein by reference in its entirety.

BACKGROUND

The present disclosure relates to a method to activate print nozzles of an inkjet printer (e.g. inkjet printer) as well as a printer having an inkjet print head configured to execute such a method.

Inkjet printers can be used in digital high-capacity printing. The use of a printer that can print to at least 10 pages of DIN A4 size per second is understood as high-capacity printing. However, printers for high-capacity printing may also be designed for higher print speeds, for example at least 30 pages of DIN A4 per second, and in particular at least 50 pages of DIN A4 per second.

Inkjet printers for digital high-capacity printing include a print head with a plurality of print nozzles. Such a print head may have several thousand print nozzles, for example. A separate actuator is associated with each print nozzle. This actuator acts as a small pump, upon the activation of which a pressure pulse is exerted on the ink located in the supply line of the print nozzle so that a droplet of ink is ejected from the respective print nozzle.

The printers often have a cleaning device to clean the print head, with which the print head may be wiped off automatically with a wiping device. For this, the surface of the print head is wetted with additional ink so that, upon wiping off the print head, dried residues of previous printing processes on the print head are dissolved and carried along by the liquid ink. Such a cleaning process interrupts the production and increases the ink consumption.

Such a cleaning of the print head must be performed if the print quality decreases. After a certain operating duration, inkjet printers may develop streaking. In particular, at high print capacity (i.e. at high print speed), the print quality decreases rapidly so that, for example, the printing operation must be interrupted every two hours to clean the print heads.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1 illustrates a printer according to an exemplary embodiment of the present disclosure.

FIGS. 2*a*-2*c* illustrate a cross-sectional view of a print nozzle according to exemplary embodiments with different respective fill states.

Figure 1:
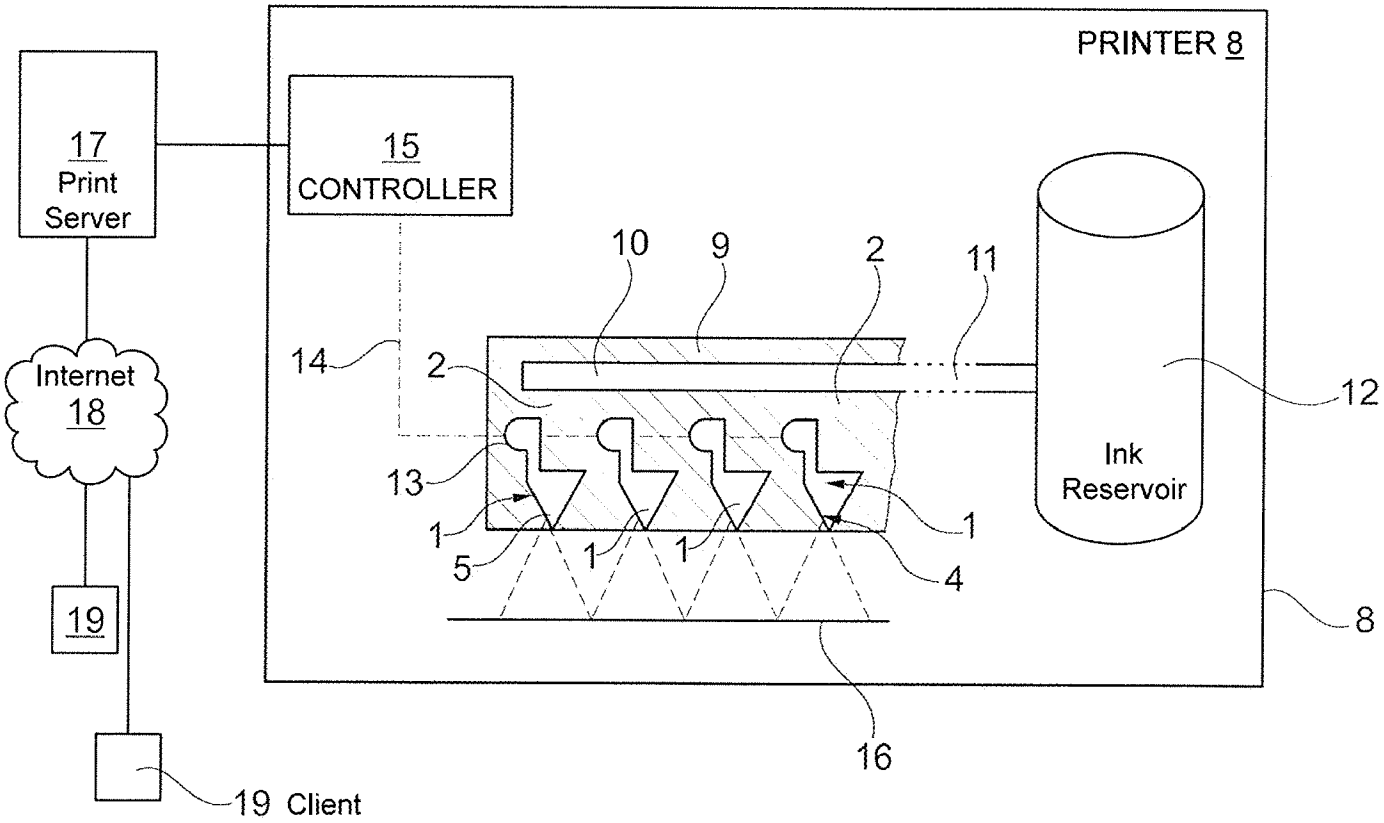

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

Exemplary embodiments of the present disclosure relate to methods to activate print nozzles of an inkjet printer that allows a very efficient operation of the inkjet printer given high throughput and/or high print quality.

Exemplary embodiments also relate to a printer having an inkjet print head that is configured to operate efficiently at high print speed and/or with high print quality.

In a method according to an exemplary embodiment of the disclosure to activate print nozzles of an inkjet printer, a print head is used that has numerous print nozzles, and a separate actuator is associated with each print nozzle. The actuators may generate a conveying pulse with which a droplet of ink is ejected from the respective print nozzle.

In an exemplary embodiment, the actuator is activated with intermediate pulses whose amplitude and/or duration is less than that of the conveying pulse, such that no ink is ejected from the respective print nozzles with the intermediate pulses.

As recognized by the inventors, the print quality, and therefore the efficiency, of the inkjet printer may, in normal printing operation, be increased with the intermediate pulses. Generally, the causes for a decline of the print quality in the operation of an inkjet printer are very complex. Given a conveying pulse, a pressure pulse is also respectively exerted on the ink located in a supply line. Since the ink quantity located in the supply line is a multiple of the ink quantity located in the print nozzle, and therefore the ink located in the supply line has significantly more inertia than the ink located in the print nozzle, a single pressure pulse has a reduce (e.g. very slight) affects the ink located in the supply line. However, print heads of inkjet printers have a plurality of print nozzles, such that numerous pressure pulses are generated simultaneously and at short intervals. The pressure pulses can respectively act on the ink located in the supply line. In addition to this, the individual print nozzles are activated at high frequency. That is, multiple conveying pulses can be generated within a brief time interval. Several tens of thousands of conveying pulses can be generated per second. These conveying pulses of the different print nozzles may in part be executed simultaneously, or the conveying pulses can be executed with a slight offset. Pressure fluctuations are generated in the ink located in the supply line (e.g. based on the conveying pulses). These pressure fluctuations in turn affect the ink located in the individual print nozzles and may lead to the situation that the droplet size emitted upon a conveying pulse may vary, and/or that less ink is subsequently conveyed to the individual print nozzles.

Figure 2A:
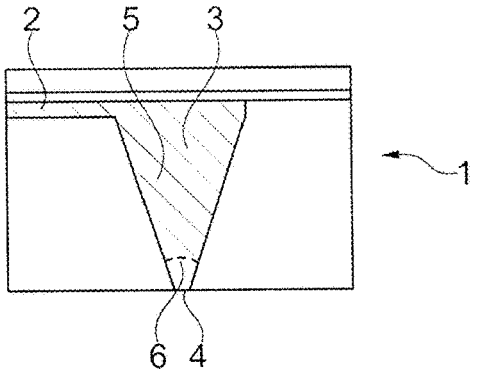
Figure 2B:
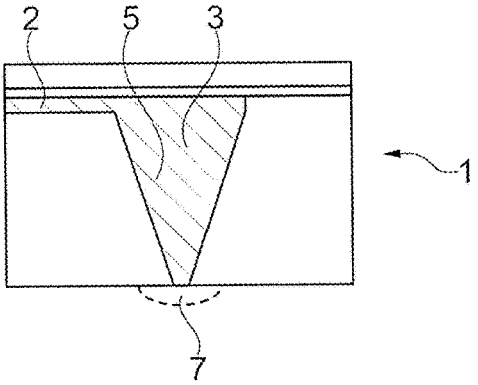
Figure 2C:
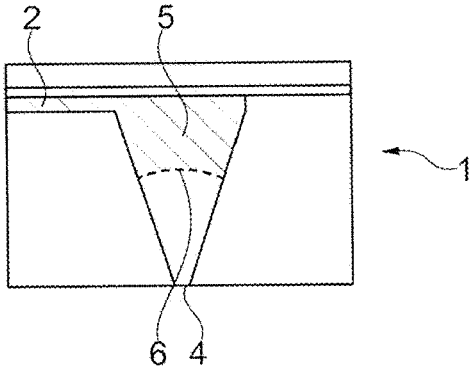

The effects of these pressure fluctuations are explained with reference to FIGS. 2*a* through 2*c*, FIG. 2*a* schematically shows a print nozzle 1 with a feed line 2, a conical nozzle chamber 3 which opens with its point at a nozzle opening 4. FIG. 2*a* shows an optimal fill state of the print nozzle 1 with ink 5. In the nozzle chamber 3, immediately behind the nozzle opening 4, the ink 5 forms a small, inwardly curved surface (e.g. concave) which is designated as a meniscus 6. The meniscus 6 represents a boundary surface between the ink 5 and the ambient air. The ink can dry out in the region of the meniscus 6.

If, due to the pressure fluctuations explained above, smaller droplets than should be generated in normal operation are generated upon a conveying pulse, additional ink then collects in the region of the nozzle chamber 3. The additional ink may protrude from the nozzle opening 4 and, outside the nozzle chamber 3, may form an outwardly curved surface (e.g. convex) which is designated as meniscus 7 spanning the nozzle opening 4. In contrast, if droplets that are too large are generated upon the conveying pulses due to the pressure fluctuations, then the fill state of ink per print nozzle 1 decreases. The ink 5 hereby retracts significantly further into the nozzle chamber 3 and forms a large meniscus 6 (FIG. 2*c*).

As recognized by the inventors, an underfilling of a print nozzle according to FIG. 2*c* takes place significantly more often than an overfilling according to FIG. 2*b*, since given the one-time overfilling, the amount of ink 5 accelerated in the print nozzle at the next conveying pulse is relatively large, whereby a larger ink droplet is ejected due to the inertia of the ink. The danger of an underfilling of the nozzle chamber 3 then exists. This underfilling may intensify in steps due to the smaller ink quantity in the nozzle chamber 3, up to the point of such an extreme underfilling as is depicted in FIG. 2*c*.

A fill state of the nozzle chamber 3 that deviates from the ideal state may not only negatively affects the droplet size, but may also lead to the inclusion of air bubbles in the ink 5. The droplet shape that is ejected upon a conveying pulse may be uncontrolled due to air bubbles, which may lead to significant deviations of the spray cone of a nozzle. The print image may hereby be negatively affected.

In exemplary embodiments of the present disclosure, these negative effects are counteracted with the intermediate pulses. On the one hand, the normally decreasing fill state of the print nozzles is remedied with the intermediate pulses in that ink is subsequently conveyed into the respective print nozzle. On the other hand, the intermediate pulses also act on the ink located in the supply line and, since they are generated outside of the clock timing of the conveying pulses, they counteract a resonance of the pressure fluctuations in the ink of the supply line. The pressure fluctuations at the individual print nozzles are hereby reduced.

With the intermediate pulses according to exemplary embodiments of the disclosure, the operation of an inkjet printer may be significantly extended between the individual cleaning processes without the quality of the print image hereby decreasing. The efficiency of the inkjet printer may hereby be increased and the quality of the printing by the printer may hereby be improved. Since fewer cleaning processes are to be executed, the consumption of ink is reduced. An optimal filling of the nozzle chambers leads to a reduction of the deposition in the region of the nozzle openings 4, whereby the print quality is increased.

In an exemplary embodiment, the optimal number, duration and/or amplitude of the intermediate pulses depends on the geometry of the nozzle chambers 3, the number of print nozzles 1 that are supplied via the same supply line, the ink quality, and/or the surface condition of the print nozzles (e.g. particularly in the region of the nozzle openings 4). In an exemplary embodiment, an optimal setting of the intermediate pulses may be determined with one or more tests. In an exemplary embodiment, the print quality is kept consistent with intermediate pulses after at least 50 conveying pulses, at least 100 conveying pulses, or at least 200 conveying pulses.

It has also been shown that the intermediate pulses are very efficient, in particular given an operation of the print nozzles with the generation of the conveying pulses at high frequency. A high frequency of conveying pulses results in a high print speed of the recording medium, and therefore a high productivity of the printer. In particular, at high frequencies of the conveying pulses of at least 50 kHz or at least 60 kHz, there is a high risk of the degradation of the print quality which may be counteracted with the intermediate pulses. The intermediate pulses according to exemplary embodiments of the disclosure thus also contribute to an increase in the productivity in that the inkjet printer may be operated with consistent print quality at a high print speed.

In an exemplary embodiment, the printer includes a print head in which stub/feed lines lead from a common supply line to supply of ink to the respective print nozzles. In an exemplary embodiment, one of the actuators is arranged in each stub/feed line. In an exemplary embodiment, a piezo-actuator is configured as an actuator.

In an exemplary embodiment, the print head has at least, for example, 500 print nozzles, at least 1000 print nozzles, or at least 2000 print nozzles, but is not limited thereto.

In an exemplary embodiment, at least 100 print nozzles, at least 200 print nozzles, or all of the print nozzles are supplied with ink via a common supply line.

In an exemplary embodiment, the print nozzles include a coating that decreases the surface tension.

In an exemplary embodiment, the duration of the conveying pulses range from, for example, 5 to 20 μs, but are not limited thereto.

In an exemplary embodiment, the duration of the intermediate pulses are in a range from, for example, 5% to 20% of that of the conveying pulses, but is not limited thereto.

In an exemplary embodiment, the duration of the intermediate pulses is in a range from, for example, 1 μs to 2 μs, but is not limited thereto.

In an exemplary embodiment, the conveying pulses and the intermediate pulses are operated with the same amplitude or intensity. In this example, the actuators may hereby be activated with a binary signal that, for example, applies a predetermined, respectively identical electrical voltage to the actuator for the respective duration of the conveying pulse or of the intermediate pulse. In one or more embodiments, the conveying pulses and the intermediate pulses are operated with different amplitudes or intensities.

In an exemplary embodiment, the printer includes an inkjet print head having multiple print nozzles. In an exemplary embodiment, a separate actuator configured to generate a conveying pulse is associated with each print nozzle. The conveying pulse can eject a droplet of ink from the respective print nozzle. In an exemplary embodiment, the printer includes a controller that is configured to activate the actuators. The controller can be configured to execute one or more of the methods according to aspects of the present disclosure. In an exemplary embodiment, the controller includes processor circuitry that is configured to perform one or more functions and/or operations of the controller.

FIG. 1 schematically shows an inkjet printer 8 according to an exemplary embodiment of the present disclosure. The printer 8 can be configured to perform one or more of the method according to aspects of the disclosure in a simplified manner. As is understood by one of ordinary skill in the relevant arts, the printer 8 as illustrated in FIG. 1 can include one or more additional conventional printing components. In an exemplary embodiment, the inkjet printer 8 includes a print head 9 having a plurality of print nozzles 1. In an exemplary embodiment, the print nozzles 1 respectively include a conical nozzle chamber 5 that, at the conically expanded end, are connected to a respective feed line 2. The feed lines 2 are further connected to a common supply line 10, and the feed lines 2 are configured as stub lines or branch lines that branch from the supply line 10 to the respective print nozzles 1. Outside of the print head 9, the supply line 10 is connected with a connection line 11 which leads to an ink reservoir 12. Arranged at each feed line 2 is an actuator 13 configured to place the ink located in the feed line 2 under pressure. In an exemplary embodiment, the actuators 13 are piezoactuators. In an exemplary embodiment, the actuators 13 are activated electronically, but may be activated using other means such as mechanically or pneumatically. The actuators 13 can be connected with a central controller 15 via one or more control lines 14.

In an exemplary embodiment, the individual print nozzles 1 respectively have a nozzle opening 4 that is arranged at a side of the print head 9 that faces toward a recording medium 16.

In operation, the recording medium 16 may be conveyed along a conveyor belt past the print head 9 (e.g. using a conveying device, not shown) so that a two-dimensional image is generated on the recording medium 16 via successive emission of printing ink by the print nozzles 1 arranged in one or more rows. In one or more other embodiments, the print head 9 may move relative to a stationary or moving recording medium 16.

For the sake of simplicity, only one print head 9 with a few print nozzles 1 is depicted in FIG. 1. However, in an exemplary embodiment, an inkjet printer 8 includes multiple print heads 9 having multiple nozzles 1, where the various print heads 8 are respectively supplied with a different print color to print different colors onto a recording medium 16. Furthermore, the print heads 9 possess a plurality of print nozzles, such as more than 500, more than 1000, or more than 2000 print nozzles that are arranged in multiple rows, but are not limited to these exemplary number of nozzles. In an exemplary embodiment, the print nozzles of the different rows are respectively arranged offset a bit relative to the adjacent row to generate a print image with high resolution.

In an exemplary embodiment, the controller 15 is connected with a print server 17. In an exemplary embodiment, the print server 17 is configured to transmit the print data to the controller 15 of the inkjet printer 8. In an exemplary embodiment, the controller 15 is configured to raster the print data, and the rastered print data is used to activate the individual actuators 13. In an exemplary embodiment, the controller 15 includes processor circuitry that is configured to perform one or more functions and/or operations of the controller 15.

In an exemplary embodiment, the print server 17 is connected via a local area network (LAN) and/or a wide area network (WAN) (e.g. the Internet 18) with one or more clients 19 at which print jobs are generated.

Figure 3:
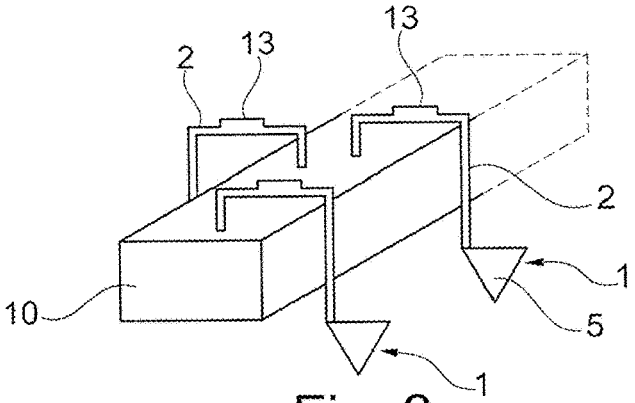
FIG. 3 illustrates a supply line having branch lines to the respective print nozzles according to an exemplary embodiment of the present disclosure.

In an exemplary embodiment, the supply line 10 and the feed lines 2 are configured in a three-dimensional arrangement (FIG. 3) so that two rows of print nozzles 1 are located adjacent to a supply line 10.

In an exemplary embodiment, if one of the actuators 13 is operated by the controller 15, the actuator 13 then places the ink located in the corresponding feed line 2 under pressure. Since the ink may escape from the print nozzle 1 through the nozzle opening 4 (and additionally, significantly less ink is located in the print nozzle 1 than in the supply line 10) the pressure pulse in the feed line 2 has the effect that printing ink may be ejected from the nozzle opening 4. If such a pressure pulse is maintained over a predetermined duration (e.g. at least 5 μs), an ink droplet is ejected from the nozzle opening 4. At the end of the pressure pulse, the actuator 13 assumes its initial position again, whereby a negative pressure is generated in the feed line 2. In an exemplary embodiment, the print nozzle 1 and the feed lines 2 as well as the supply line 11 are configured such that this negative pressure on the one hand leads to a certain retraction of the ink into the nozzle chamber 3, and on the other hand to the subsequent conveyance of ink from the supply line 11 in the direction of the print nozzle 1. In an exemplary embodiment, the inertia of the ink located in the print nozzle, which has been accelerated outward toward the nozzle opening 4 by the conveying pulse can reduce the retraction of the ink that was not sprayed out/ejected from the nozzle opening after a conveying pulse into the nozzle chamber 3, as is shown in FIG. 2*a*.

With reference to FIGS. 2*a* through 2*c*, as explained above, at a high frequency of conveying pulses, larger ink droplets than intended may be emitted at the individual conveying pulses, and/or that smaller quantities of ink are subsequently supplied. Further, with an increasing number of conveying pulses, the ink 5 is retracted further into the nozzle chamber 3 at the end of each conveying pulse, and the meniscus 6 becomes increasingly larger.

Figure 4:
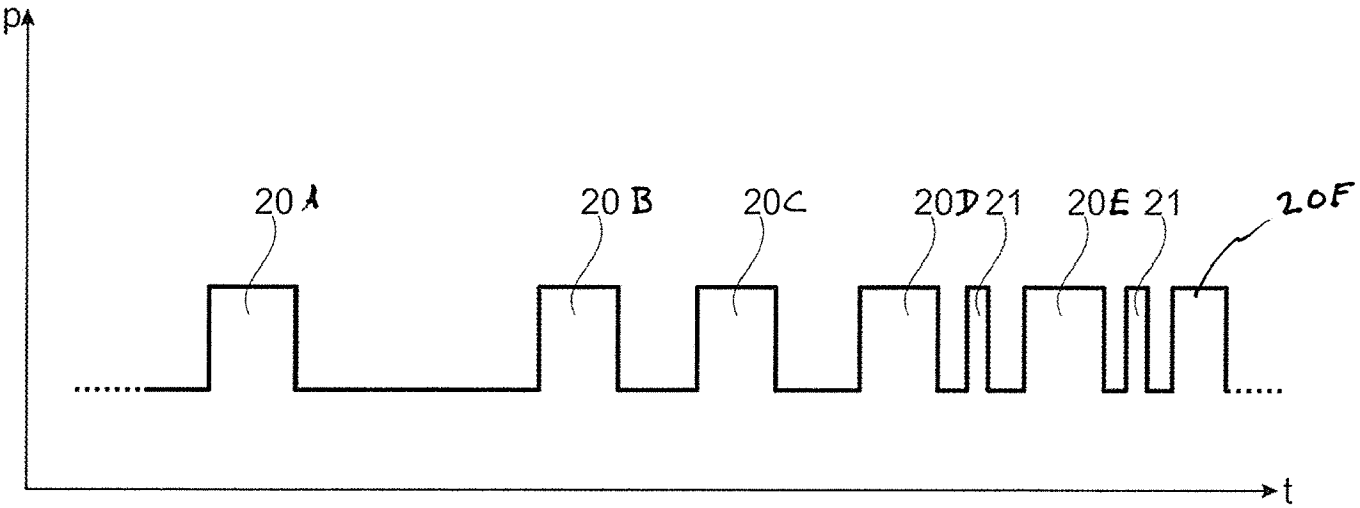
FIG. 4 illustrates conveying pulses and intermediate pulses in a pressure/time diagram according to an exemplary embodiment of the present disclosure.

In an exemplary embodiment, with reference to FIG. 4, intermediate pulses 21 may therefore be generated between the conveying pulses 20. An example of the chronological signal curve of a specific nozzle is shown in FIG. 4.

In an exemplary embodiment, the duration of a conveying pulse is, for example, 10 μs. The conveying pulses 20 are executed with a clock timing of 20 μs, meaning that there is a pause of at least 10 μs between each conveying pulse 20. This corresponds to a frequency of 50 kHz of conveying pulses. In an exemplary embodiment, the intermediate pulses 21 are generated over a duration of, for example, 1 to 2 μs, but are not limited thereto. In an exemplary embodiment, the intermediate pulses 21 may therefore be executed in the pauses between the successive conveying pulses 20.

In an exemplary embodiment, at least one intermediate pulse 21 is applied if the time interval between two conveying pulses 20C and 20D of a specific nozzle is insufficiently long, such that the pressure fluctuation or fluid oscillation within the nozzle chamber 3 has on its own attenuated to a certain degree. In contrast to this, the time interval between the conveying pulse 20A and the conveying pulse 20B is long enough so that the pressure fluctuation calms by itself.

In an exemplary embodiment, the number of conveying pulses 20 in which an ink droplet is respectively ejected is counted (e.g. by the controller 15), and upon reaching a predetermined threshold, one or more intermediate pulses 21 are generated (e.g. by the controller 15) which are dimensioned so that no ink droplets are ejected. In an exemplary embodiment, the intermediate pulses 21 are shorter than the conveying pulses 20 and/or have a smaller amplitude (e.g. a smaller pressure value). In an exemplary embodiment, the number of conveying pulses after which one or more intermediate pulses are to be generated can be at least 50 conveying pulses, at least 100 conveying pulses, or at least 200 conveying pulses, but is not limited thereto. A different minimum number of conveying pulses, or a different threshold of conveying pulses, may be appropriate based on the design/configuration of the geometry of the print nozzles, of the feed lines 2, of the supply line 10, and/or of the actuator 13. The minimum number of conveying pulses and/or a different threshold of conveying pulses may also depend on the type of ink that is used. The minimum number of conveying pulses until execution of intermediate pulses 21 may also be, for example, 500 or 1000, but is not limited thereto.

In an exemplary embodiment, if the threshold of the minimum number of conveying pulses 20 is exceeded, an intermediate pulse 21 (or multiple pulses 21) may then be executed.

In an exemplary embodiment, the intermediate pulses 21 are executed in the pauses between the conveying pulses 20 (e.g. since the intermediate pulses 21 are shorter than the pauses).

In an exemplary embodiment, conveying pulses 20 are not generated with every clock cycle. For example, the conveying pulses 20 can be generated with the maximum clock timing only in a region of maximum color density. However, most regions of a print image do not have the maximum color density, such that normally a few conveying pulses are generated with the maximum clock timing and larger pauses always occur again between successive conveying pulses 20. Within the scope of the disclosure, it is also possible to execute the intermediate pulses 21 exclusively in pauses between two successive conveying pulses 20 that are not emitted with the maximum clock timing, thus with the minimum pause between two successive conveying pulses 20. Given such a method, after reaching the minimum number of conveying pulses 20, a check can be performed as to when a predetermined pause next occurs between two successive conveying pulses 20 to execute the intermediate pulse 21 therein. With such a method, a pulse sequence of conveying pulses 20 may also be used in which the conveying pulses 20 are significantly longer at maximum clock timing than the pauses located between them. For example, the conveying pulses may have a duration of 12 to 13 μs, and the maximum clock timing may be merely 15.6 μs. That is, the conveying pulses are output with a frequency of 64 kHz.

In an exemplary embodiment, this method is executed separately for each print nozzle 1.

In an exemplary embodiment, because methods according to the aspects of the present disclosure are especially efficient given a print head 9 having numerous print nozzles 2, and because the pressure pulses of the individual print nozzles 1 may crosstalk via the supply line 10 to the other print nozzles 1, it may also be appropriate to count the number of conveying pulses 20 across multiple print nozzles 1, in particular across multiple adjacent print nozzles 1, to trigger intermediate pulses at individual print nozzles 1 upon reaching a minimum count.

In an exemplary embodiment, the intermediate pulses 21 may be predetermined and integrated into the print data in the preparation of the print data in the print server 17, or after the rastering of the print data in the controller 15.

In an exemplary embodiment, the actual sequence of conveying pulses 20 that is generated at the respective print nozzles 1 are determined at the print head 9, and the generation of intermediate pulses 21 are accordingly determined. Given the latter, the actual print speed may be taken into account since the necessity to generate intermediate pulses 21 is not as great given a slow print speed (and therefore large pauses between the individual conveying pulses 20) than given a high print speed (at which the pauses between the individual conveying pulses 20 are shorter and the pressure fluctuations that are generated by conveying pulses 20 in very rapid succession may be significantly more pronounced).

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc.

Further, any of the implementation variations may be carried out by a general purpose computer.

For the purposes of this discussion, "processor circuitry" can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 print nozzle
2 feed line
3 nozzle chamber
4 nozzle opening
5 ink
6 meniscus (e.g. concave)
7 meniscus (e.g. convex)
8 inkjet printer
9 print head
10 supply line
11 connecting line
12 ink reservoir
13 actuator
14 control line
15 central controller
16 recording medium
17 print server
18 internet/network
19 client
20 conveying pulse
21 intermediate pulse

The invention claimed is:

1. A method to active print nozzles of an inkjet printer including a print head having print nozzles and respective actuators associated with each of the print nozzles, the method comprising:

generating, by an actuator of the respective actuators, one or more conveying pulses to eject respective droplets of ink from the respective print nozzle;

determining a time interval between two conveying pulses of the one or more conveying pulses of one of the print nozzles;

selectively activating the actuator with one or more intermediate pulses based on the determined time interval, the one or more intermediate pulses having an amplitude and/or a duration that is less than an amplitude and/or a duration of the one or more conveying pulses, wherein the one or more intermediate pulses are configured such that no ink is ejected from the respective print nozzle with the one or more intermediate pulses.

2. The method according to claim 1, wherein a respective intermediate pulse of the one or more intermediate pulses is executed at the respective print nozzle after a predetermined number of the one or more conveying pulses and/or after a predetermined time interval.

3. The method according to claim 2, wherein the predetermined number of the one or more conveying pulses is at least 200.

4. The method according to claim 1, wherein the one or more intermediate pulses are executed in response to the conveying pulses being executed with a predetermined minimum frequency.

5. The method according to claim 4, wherein the predetermined minimum frequency is 10 kHz, 50 kHz, or 60 kHz.

6. The method according to claim 1, wherein the one or more intermediate pulses is applied at the actuator based on the data to be printed and in response to an expected specific pressure fluctuation being exceeded in a respective nozzle chamber.

7. The method according to claim 1, wherein the one or more intermediate pulses is applied at the actuator in response to the time interval between two conveying pulses of the one or more conveying pulses of one of the print nozzles being of an insufficient duration to allow a pressure fluctuation within a corresponding nozzle chamber of the one of the print nozzles to attenuate on its own to a specific extent.

8. The method according to claim 1, wherein the print head further comprises:

a supply line configured to supply ink; and stub lines that branch from the supply line to each of the individual print nozzles, the actuators being respectively arranged in the stub lines.

9. The method according to claim 1, wherein at least one of the actuators is a piezoactuator.

10. The method according to claim 1, wherein the print head comprises at least 2000 of the print nozzles.

11. The method according to claim 1, wherein the print nozzles comprise a coating configured to decrease surface tension.

12. The method according to claim 1, wherein the duration of the one or more conveying pulses is in a range from 5 to 20 μs.

13. The method according to claim 1, wherein the duration of the one or more intermediate pulses is 5% to 20% of that of the one or more conveying pulses.

14. The method according to claim 1, wherein the duration of the one or more intermediate pulses is 1 μs to 2 μs.

15. The method according to claim 1, wherein:

the duration of the one or more intermediate pulses is 1 μs to 2 μs; and the duration of the one or more conveying pulses is 5 to 20 μs.

16. A non-transitory computer-readable storage medium with an executable program stored thereon, wherein, when executed, the program instructs a processor to perform the method of claim 1.

17. The method according to claim 1, wherein:

the actuator is activated with the one or more intermediate pulses if the determined time interval is less than a time threshold value; and the actuator is not activated with the one or more intermediate pulses if the determined time interval is greater than the time threshold value.

18. The method according to claim 1, wherein the two conveying pulses of the one or more conveying pulses are two consecutive conveying pulses, the one or more intermediate pulses being between the two consecutive conveying pulses.

19. A printer comprising:

an inkjet print head including print nozzles and separate actuators being respective associated with each of the print nozzles and configured to generate a conveying pulse to eject a droplet of ink from the respective print nozzle; and a controller that is configured to:

activate the actuators to generate one or more conveying pulses to eject respective droplets of the ink from the respective print nozzle;

determine a time interval between two conveying pulses of the one or more conveying pulses;

selectively activate the actuators with one or more intermediate pulses based on the determined time interval, the one or more intermediate pulses having an amplitude and/or a duration that is less than an amplitude and/or a duration of the one or more conveying pulses, the one or more intermediate pulses being configured such that no ink is ejected from the respective print nozzle with the one or more intermediate pulses.

* * * * *